United States Patent [19]

Warner

[11] 3,967,662

[45] July 6, 1976

[54] CONTAINER FILLING APPARATUS

[75] Inventor: Graeme W. Warner, Hinsdale, Ill.

[73] Assignee: John R. Nalbach Engineering Company, Inc., Chicago, Ill.

[22] Filed: June 20, 1975

[21] Appl. No.: 588,824

[52] U.S. Cl. ..... 141/148; 141/374
[51] Int. Cl.[2] ..... B65B 43/50; B65B 43/58
[58] Field of Search ..... 141/129–191, 141/250–284, 374

[56] References Cited

UNITED STATES PATENTS

| | | | |
|---|---|---|---|
| 1,073,067 | 9/1913 | Ayars | 141/146 |
| 2,185,201 | 1/1940 | Kraus et al. | 141/146 |
| 2,711,849 | 6/1955 | Gale | 141/146 |

*Primary Examiner*—Houston S. Bell, Jr.
*Attorney, Agent, or Firm*—Anthony S. Zummer

[57] ABSTRACT

The subject matter contained herein is directed to an apparatus for filling like containers with a like given amount of divided matter. The apparatus includes a housing and a drive mounted in the housing. A filling turret is positioned in the housing. The filling turret has a rotatable portion connected to the drive. The filling turret includes a filling tank having a rotatable base connected to and rotated by said drive. A plurality of measuring flasks is arranged in a circle having its center concentric with the axis of rotation of the rotatable portion of the filling turret. The measuring flasks are connected to the rotatable base of the filling tank for receiving divided matter from the filling tank. Each of the flasks includes a head having its upper end flush with the rotatable base. Each head has a tapered filling aperture contained therein. The larger portion of the aperture is adjacent to the filling tank. Each flask includes a thin wall tube connected to the head extending downward therefrom. The interior of the thin wall tube is aligned with the lower smaller portion of the filling aperture. A container pocket is positioned adjacent to each of the measuring flasks. Said container pockets rotate with the rotatable portion of the filling tank. An input conveyor delivers open-ended empty containers to the container pockets. A container elevator lifts each of the empty containers into telescoping relationship with its respective measuring flask. The containers are held on an arcuate support while they are filled with divided matter. The containers are then delivered to an output conveyor..

9 Claims, 5 Drawing Figures

Fig. 3
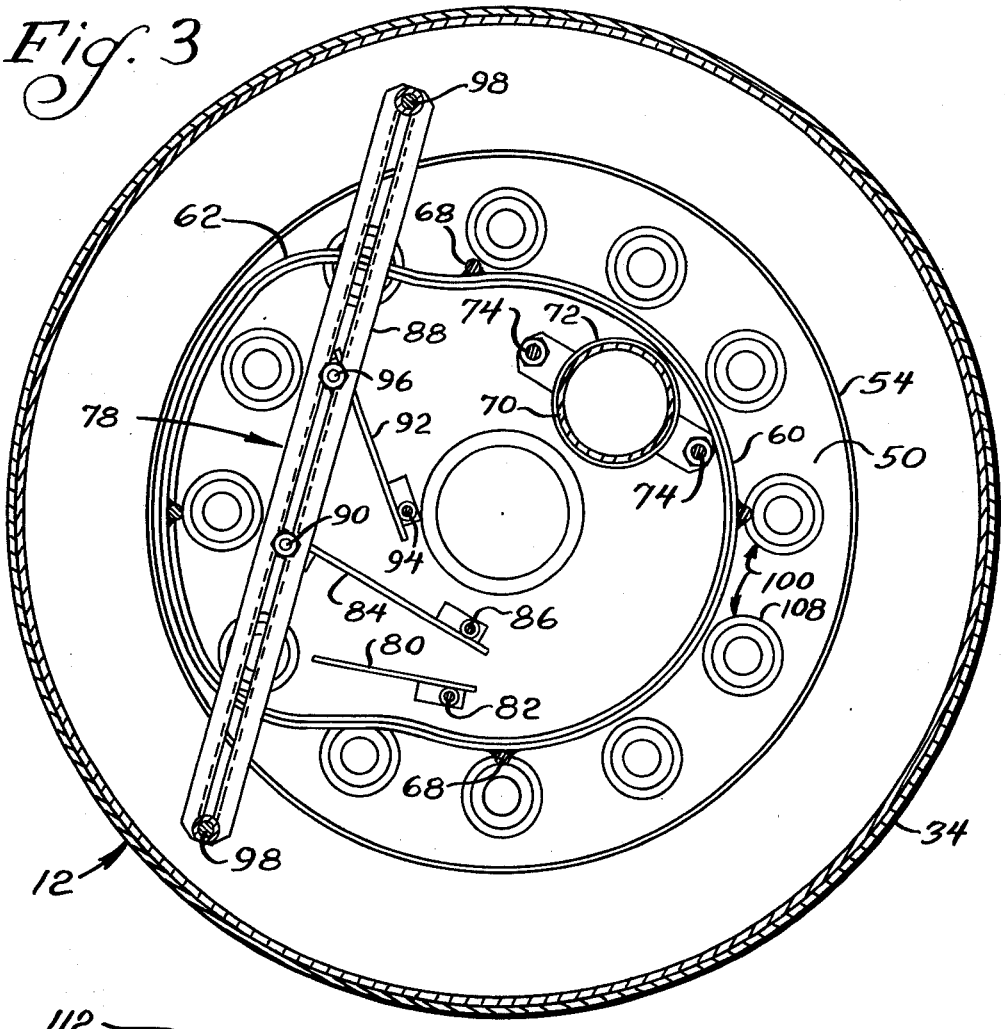
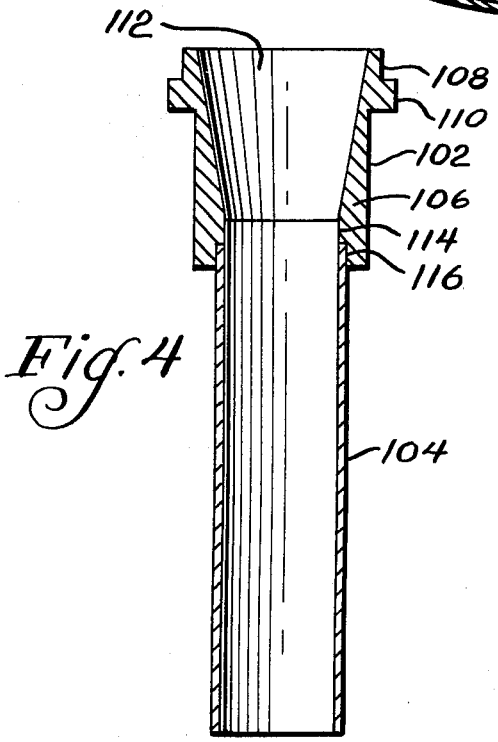
Fig. 4
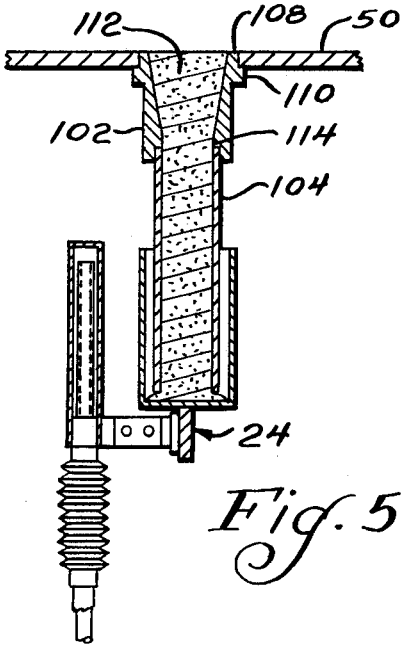
Fig. 5

CONTAINER FILLING APPARATUS

BACKGROUND OF THE INVENTION

An apparatus for filling open-ended containers with free-flowing powdered or granular material is well-known. These powdered or granular materials include a broad range of food products, including, milk products, condiments, tea, coffee, sugar, salt, cocoa, rice and seeds, as well as a general chemical line, including, cleansers, detergents, insecticides, drain and bowl cleaners, lyes, crystals, and the like. An apparatus of this general type is disclosed in U.S. Pat. No. 2,849,033, issued Aug. 26, 1958, to John R. Nalbach. Apparatus of this general type has found a wide range of acceptance in the food industry, chemical industry, and cosmetic industry, for packaging all manner of dry materials. In the course of the operation of the prior art apparatus, a problem has occurred when the containers to be filled have a relatively narrow diameter. The problem is that the apparatus (which has a measuring flask for determining the volume of material to be placed in the container) does not become filled with the material. In the course of the operation of the apparatus (which depends upon a gravity feed of the material into the measuring flask), bridging occurs over the flask, so that the powdered or granular material does not flow freely axially along the measuring flask.

SUMMARY OF THE INVENTION

The present invention relates to an improved construction for an apparatus used in filling like containers with a like measured amount of powdered or granulated material. The apparatus includes a housing, with a drive mounted in the lower portion of the housing. A filling turret having a rotatable portion is mounted in the housing. The rotatable portion is driven by said drive. The filling turret includes a filling tank, which includes a rotatable base which rotates with the rotatable portion of the filling turret. A plurality of measuring flasks is connected to the rotatable base of the filling tank for receiving matter from the tank and measuring the amount of material received. Said measuring flasks are arranged in a vertical attitude in a circle having its center concentric with the center of rotation of the rotatable portion of the filling turret. Each of the measuring flasks includes a head having its upper portion flush with the rotatable base of the filling tank. Each head has a filling aperture, which is a truncated portion of a cone having a slope on the side of approximately 10°. The filling aperture has its wider portion adjacent to the filling tank. Each measuring flask includes a thin wall right-circular cylindrical tube, having its interior aligned with the smaller portion of the filling aperture to allow a free flow of material axially along the measuring flask. The material is dispensed from the measuring flasks into its respective container.

A container pocket is positioned adjacent to each of the measuring flasks; and revolves with its respective flask. An input conveyor delivers empty containers to the container pockets. A container elevator raises the empty containers to an arcuate container support, which is parallel to the path of movement of the measuring flasks. The containers are carried along the arcuate support in a telescoping relationship with the measuring flask to receive material from the measuring flasks. The containers are then delivered to an output conveyor, which carries away the filled containers. It is a principal object of this invention to provide an improved apparatus for filling like containers, which containers are filled with a prescribed amount of material, as determined by the measuring flask.

It is another object of the instant invention to provide an improved container filling apparatus which utilizes gravity in the filling of measuring flasks.

It is a still further object of the herein-disclosed invention to provide an apparatus for filling like containers in an economical and efficient manner.

Other objects and uses of the present invention will become apparent to those skilled in the art upon a perusal of the following specification in light of the accompanying drawings.

DESCRIPTION OF THE DRAWINGS

FIG. 3 is a cross-sectional view taken on Line 3—3 of FIG. 1, showing the interrelationship of a filling tank and positioning of measuring flasks relative to the tank;

FIG. 4 is an enlarged cross-sectional view of one of the measuring flasks; and

FIG. 5 is a cross-sectional view, showing a container in a position for receiving the material from a measuring flask.

DESCRIPTION OF THE PREFERRED EMBODIMENT

Figure 1:
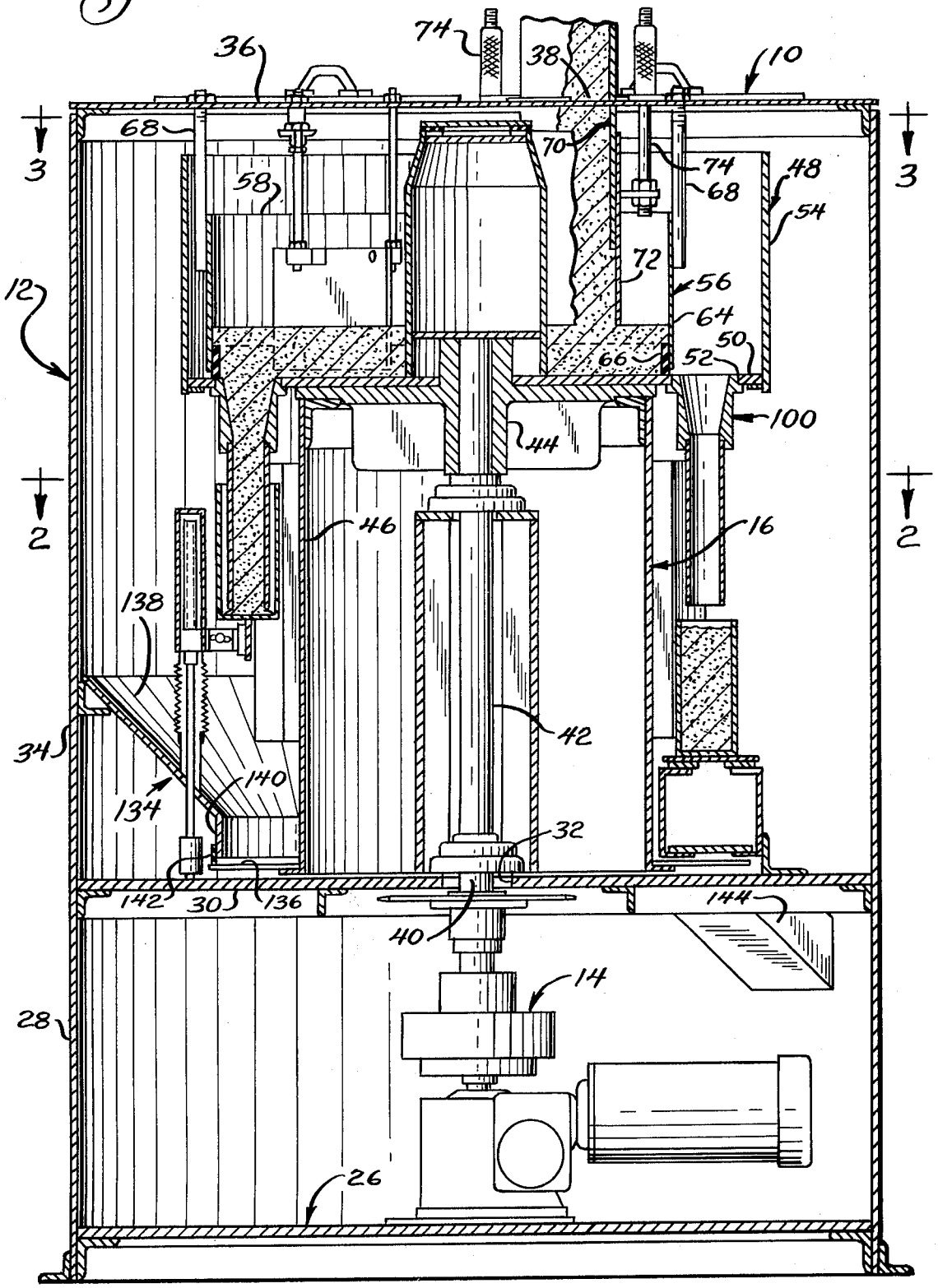
FIG. 1 is a cross-sectional elevational view of a container filling apparatus embodying the herein-disclosed invention.
Figure 2:
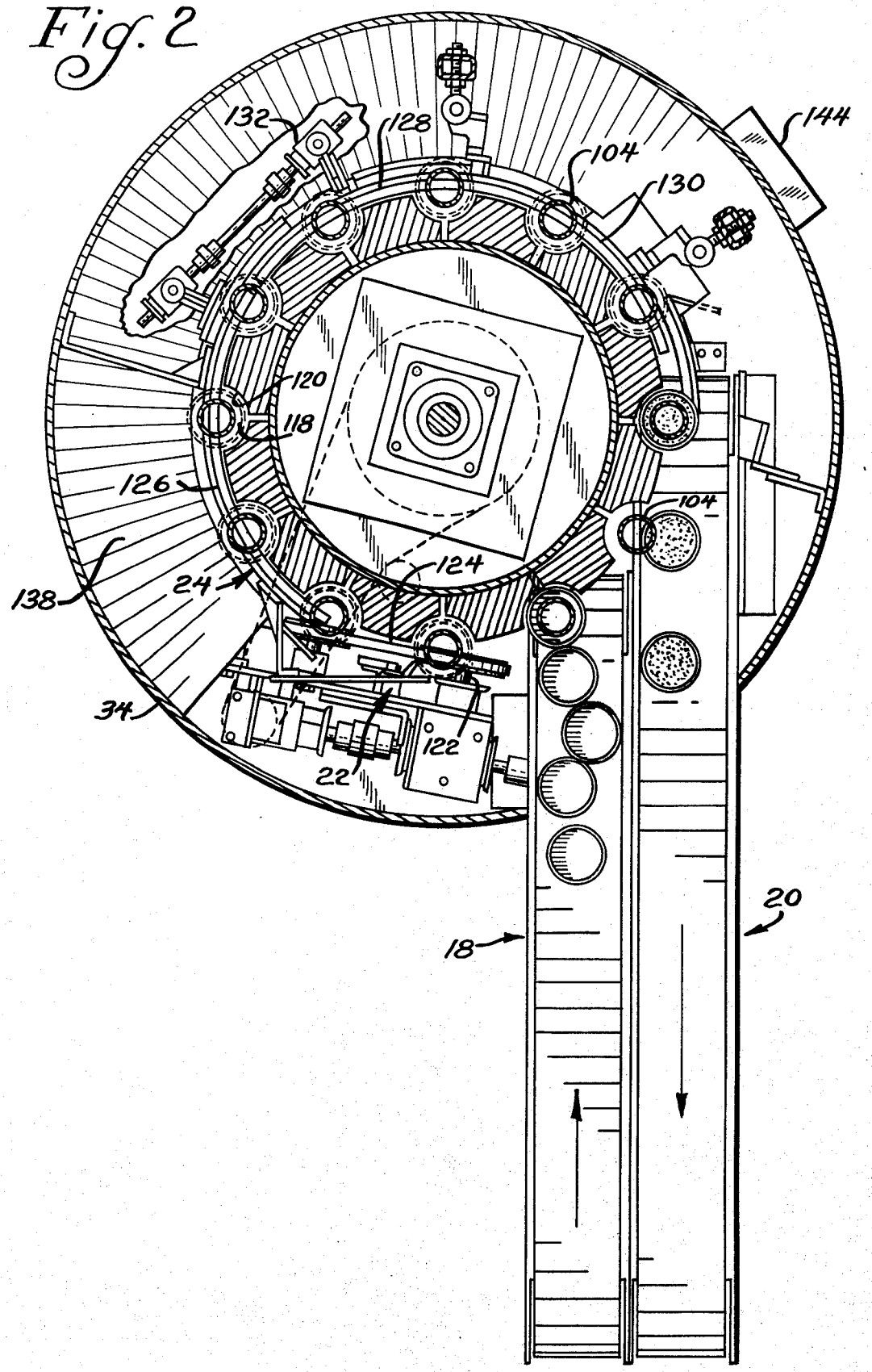
FIG. 2 is a cross-sectional view of the apparatus shown in FIG. 1, taken on Line 2—2 of FIG. 1, showing the interrelationship of an input and an output conveyor relative to the remainder of the apparatus.

Referring now to the drawings, and especially to FIG. 1, a container filling apparatus embodying the instant invention is generally indicated therein by numeral 10. The apparatus 10 generally consists of a housing 12, with a conventional variable drive 14 mounted in the housing. A filling turret 16 is mounted in the upper portion of the housing and is drivingly connected to drive 14. Looking now to FIG. 2, it may be seen that an input conveyor 18 is connected to the housing for delivering empty containers to filling turret 16. An output conveyor 20, which is parallel to input conveyor 18, is positioned adjacent to the filling turret for receipt of filled containers. A container elevator 22 is mounted in the housing for raising empty containers to an arcuate container support 24.

As may be best seen in FIG. 1, housing 12 generally includes a support 26, upon which is mounted drive 14. A skirt 28 has its lower edge connected to support 26 to enclose drive 14. A filler floor 30 is mounted on the upper portion of the skirt. The filler floor includes a drive aperture 32 in the center thereof for receiving a portion of drive 14. A filler wall 34 is connected to the skirt to form a continuous exterior housing. The filler wall has a pair of doors (not shown herein) to provide for egress into the interior of the machine for service thereof. The housing also includes a roof 36, which has an inlet aperture 38 contained therein to provide an opening for delivering powdered or granulated material to the interior of the housing.

The drive 14 is a conventional and well-known electrical motor-speed reducer combination, with an output shaft 40 extending therefrom through aperture 32.

The filling turret 16 includes a drive shaft 42, which is connected to shaft 40. The drive shaft 42 is drivingly connected to a hub 44, which has a drum 46 mounted on its outer periphery. A filling tank assembly 48 is mounted on the upper portion of hub 44.

The filling tank assembly includes a tank floor or rotatable base 50, with a plurality of flask apertures 52 contained therein. The floor is fixed to hub 44. The flask apertures 52 are arranged in a circle about the center of floor 50, which center of the floor is concentric with the axis of rotation of the tank floor. The filling tank assembly includes a side wall 54, which is fixed to the outer periphery of floor 50. A retainer 56 is mounted within the side wall 54. The retainer has its lower edge positioned in sliding engagement with floor 50. The retainer includes a continuous wall 58, which has a central loop 60 and a filling loop 62. The retainer wall generally consists of two parts, namely, a sheet metal upper wall 64 and a resilient scraper assembly 66 connected to the lower edge of the sheet metal upper wall 64. The scraper assembly 66 has a scraper blade, which is fixed to the sheet metal wall 64 by a plurality of fasteners (which are not shown). The scraper assembly is in scraping engagement with the floor 50 to retain a material within the retainer. The continuous wall 54 is suspended from roof 36 by a plurality of roof supports 68, so that the retainer is held relative to the housing, while floor 50 rotates relative to the housing.

An inlet tube 70 is positioned in inlet aperture 38 and terminates below the upper level of the retainer 56, as may be best seen in FIG. 1. The upper end of inlet tube 70 is connected to a source of powdered or granular material, which source is not shown herein, but is conventional in the art. A telescoping inlet sleeve 72 is movably mounted on the inlet tube 70. The inlet sleeve 72 is connected to a plurality of sleeve adjustment rods 74, which are mounted in roof 36 to raise and lower sleeve 72 relative to floor 50 to regulate the depth of material contained within the retainer.

The filling tank assembly also includes a product guide 78, mounted within the housing. The product guide includes an outer vane 80, which is supported from roof 36 by a conventional rod 82. An adjustable center vane 84 is supported from the roof by rod 86 at one end. The other end of vane 84 is supported on an adjustment bar 88 by a fastener assembly 90, which allows the vane to be swung to a selected position for directing material in the filling tank. An inner vane 92 has one end pivotedly connected to the roof through vane rod 94. The other end of vane 92 is connected to the adjustment bar 88 by a fastener assembly 96. The adjustment bar 88 is fixed to the roof by fasteners 98.

A vertical measuring flask 100 is mounted in each of the flask apertures 52, so that the measuring flasks 100 are in a circle concentric with the axis of rotation of floor 50. Each of the measuring flasks 100 includes a head 102 and a thin wall tube 104. Each head 102 includes a head body 106, which head body 106 includes a stanchion 108 which mates with its respective aperture 52. A mounting ring 110 is formed integral with the body 106 to position the head, so that the upper end of the head is flush with the floor 50. The body includes a filling aperture 112, which includes a truncated portion of a cone having its larger end adjacent to the filling tank. The cone has a side wall, which is tapered, having a taper between 15° and 5°. It has been found that the optimum angle is 10°. The filling aperture also includes a straight wall portion 114, which is circular in cross-section and is the same size as the smaller portion of the cone of aperture 112. A mounting recess 116 is formed in the lower end of the head. Tube 104 is mounted in the recess 116. The interior diameter of the tube 104 is identical to the diameter of portion 114, so that material may flow downward from the aperture 112 into the tube and out of the bottom of the tube. All of the measuring flasks are perpendicular to the floor 50.

The filling turret also includes a plurality of container pockets 118. Each of the container pockets is defined by pocket walls 120, adapted to receive a container. The container pockets are aligned with the respective measuring flasks 100, so that a container positioned in a container pocket may be raised and lowered in the pocket and telescopically receive its respective measuring flask. The walls of the pocket are mounted on drum 46 to be carried with the drum and the tank floor as the tank floor rotates under the roof, while retainer 56 and vanes 80, 84 and 92 remain relatively fixed.

Container elevator 22 is mounted in the housing adjacent to input conveyor 18 for raising empty containers from the level of the input conveyor up to the container support 24. The container elevator includes a plurality of sheaves 122, which drive a conventional endless belt 124.

Container support 24 includes three arcuate sections. The container support includes a fixed section 126; a movable section 128; and a vibrating section 130. The fixed section 126 first receives the empty containers; and the containers are carried along the respective pockets to the movable section. The movable section 128 is supported on a height-regulating assembly 132 to adjust the height of the rail relative to the measuring flask. The vibrating section 130 is mounted on vibrators to vibrate the rail for vibrating the containers as they are filled.

Mounted within the housing is a spillage-recovery assembly 134, including an annular spill floor 136 fixed to drum 46. A generally conical dish wall 138 is fixed to the interior of wall 34. The wall 138 slopes inward and downward, as may be seen in FIG. 1. A lower side wall 140 is fixed to the interior of wall 134. A floor side wall 142 is secured to side wall 140 adjacent to the outer periphery of floor 136. A chute 144 is positioned in the housing adjacent to the end of vibrating section 130. A scraper (not shown) is mounted in the housing, in scraping engagement with the spill floor 136, to divert material from the floor into the chute 144.

The input conveyor 18 is conventional in its construction; and has a straight line movement intersecting the circular path of the container pockets. The output conveyor 20 is parallel to the input conveyor; and is tangential to the circular path of the container pockets.

In operation, the subject apparatus is adjusted for a container of a given size. An appropriate size measuring flask is selected for the quantity of material which is to be introduced into the container. Identical measuring flasks are mounted in apertures 52. Empty containers are loaded onto the input conveyor 18, which carries the empty containers toward the filling turret. The containers are delivered to their respective container pockets. The rotation of the filling turret carries the containers in the pockets to the container elevator 22, where the containers engage belt 124 and the containers are carried to the container support 24. The belt 124 delivers the containers onto the section 126, at the same time moving the container telescopically relative to its respective measuring flask, so that, when the container is positioned on the section 126, the container is in a telescoping relationship with its respective measuring flask.

Filling tank 48 is filled with a desired free-flowing powdered or granular material from the source (which is not shown). The material is delivered to inlet tube 70, where the material drops down into sleeve 72. The sleeve 72 is adjusted relative to floor 50 for a selected depth of material in the filling tank. The material is filled to a uniform level. It may be appreciated that, as the turret (with floor 50) rotates, the material is carried away from sleeve 72; but at a selected level. The material engages the vanes 80, 84 and 92, which vanes direct the material into the filler loop of the retainer. The material drops into the measuring flasks. It is important to note that, when the containers to be filled are of a relatively narrow diameter, there is a tendency of some materials to bridge over the filling aperture. The use of the tapered filling aperture 112 eliminates the bridging, so that the measuring flasks are always completely filled. As the material drops into the measuring flask, the material engages the bottom of the respective container and builds up in the measuring flask until the flask is filled. As the floor 50 continues to rotate, the head of the measuring flask (which is flush with the floor) passes under the scraper assembly 66 of the retainer, which scrapes off all of the additional material. The flask is now completely filled to a level amount.

Once the measuring flasks move past the retainer, the containers are supported on the vibratory section 130, so that the containers move away from the measuring flask. As the container is moving away and being vibrated, the container is completely filled with the material. The container is then carried onto the output conveyor, which is moving tangentially to the circle of movement of the container so that there is a minimum of likelihood of tipping of the filled container.

Although a specific embodiment of the present invention has been described in detail above, it is readily apparent that those skilled in the art may make various modifications and changes without departing from the spirit and scope thereof. It is to be expressly understood that the instant invention is limited only by the appended claims.

What is claimed is:

1. An apparatus for filling like containers with a like measured amount of divided matter, including; a housing; a drive connected to said housing; a filling turret in said housing having a rotatable portion connected to said drive, said rotatable portion being rotated by said drive at a prescribed rate, said filling turret including a filling tank having a rotatable floor connected to said drive, said rotatable floor rotated with said rotatable portion of the filling turret, a plurality of measuring flasks arranged in a circle concentric with the circle of rotation of said rotatable portion of the filling turret, said plurality of measuring flasks connected to said rotatable floor of the filling tank for receiving divided matter therefrom and measuring the amount of said matter, said plurality of measuring flasks moving in a circular path having a center concentric with the center of the circle of the plurality of measuring flasks, each of said measuring flasks having an open tapered mouth adjacent to the filling tank and a cylindrical body connected to the mouth, said tapered mouth having its wider end adjacent to the filling tank, and a container pocket positioned adjacent to each of the measuring flasks and moving therewith for carrying a container; and an arcuate container support mounted in said housing positioned below a portion of the measuring flasks for holding the containers in telescoping relationship with the measuring flasks.

2. An apparatus for filling like containers with a like measured amount of divided matter as defined in claim 1 wherein each of the measuring flasks includes a head having one end flush with the rotatable floor and containing the open tapered mouth, and the cylindrical body is a thin wall tube fixed to the head.

3. An apparatus for filling like containers with a like measured amount of divided matter as defined in claim 1 wherein the taper is 10°.

4. An apparatus for filling like containers with a like measured amount of divided matter as defined in claim 1 wherein the open tapered mouth defines a truncated cone and the cylindrical body has a right circular cylindrical aperture abutting the smaller end of the truncated cone.

5. An apparatus for filling like containers with a like measured amount of divided matter as defined in claim 1 wherein each of the measuring flasks includes a head having one end flush with the rotatable floor and containing the open tapered mouth, the taper of said mouth being 10°, and the cylindrical body is a thin wall tube fixed to the head.

6. An apparatus for filling like containers with a like measured amount of divided matter as defined in claim 1 wherein each of the measuring flasks includes a head having one end flush with the rotatable floor and containing the open tapered mouth, said open tapered mouth defining a truncated cone, and the cylindrical body is a thin wall right circular cylindrical tube fixed to the head, said tube abutting the smaller end of the truncated cone and registering with said smaller end.

7. An apparatus for filling like containers with a like measured amount of divided matter as defined in claim 1 wherein the open tapered mouth defines a truncated cone having a taper of 10°, and the cylindrical body has a right circular cylindrical aperture abutting the smaller end of the truncated cone and registering therewith.

8. An apparatus for filling like containers with a like measured amount of divided matter as defined in claim 1 wherein each of the measuring flasks includes a head having one end flush with the rotatable floor and the balance of the head extending downward from the rotatable floor, each open tapered mouth having a taper of 10°, said tapered mouth defining a truncated cone, and the cylindrical body is a thin wall tube having a right circular cylindrical aperture abutting the smaller end of the truncated cone and registering with the smaller end.

9. In an apparatus for filling like containers with a like measured amount of divided matter having a housing, a drive connected to said housing, a filling turret in said housing having a rotatable portion connected to said drive, said filling turret including a filling tank having a rotatable floor connected to said drive, a plurality of measuring flasks arranged in a circle concentric with the circle of rotation of said rotatable portion of the filling turret, said plurality of measuring flasks connected to said rotatable floor of the filling tank for receiving divided matter therefrom and measuring the amount of said matter, a container pocket positioned adjacent to each of the measuring flasks and moving therewith for carrying a container, and a container support mounted in said housing positioned below a portion of the measuring flasks for holding containers in telescoping relationship with the measuring flasks, the improvement comprising; each of the measuring flasks including a head, each head having one end flush with the rotatable floor and the balance of the head extending downward from the floor, each head having a filling aperture contained therein, each filling aperture being a truncated portion of a cone, each filling aperture having its larger end adjacent to the filling tank, said head having a cylindrical aperture as a portion of the filling aperture having the same axis as said cone and having the same diameter as the smaller portion of the cone, and a thin wall tube mounted in the lower end of the head and extending downward therefrom, said thin wall tube having a right circular cylindrical aperture aligned with the cylindrical portion of the filling aperture to allow divided matter to flow axially along the filling aperture and along the interior of the tube.

* * * * *